US011351438B2

(12) United States Patent
Dunham et al.

(10) Patent No.: US 11,351,438 B2
(45) Date of Patent: Jun. 7, 2022

(54) FOOTBALL TRAINING TOOL

(71) Applicants: Michael Ellis Dunham, Gainesville, FL (US); Daniel Lundy, Ormond Beach, FL (US); Nick Warren Dunham, Gainesville, FL (US)

(72) Inventors: Michael Ellis Dunham, Gainesville, FL (US); Daniel Lundy, Ormond Beach, FL (US); Nick Warren Dunham, Gainesville, FL (US)

( * ) Notice: Subject to any disclaimer, the term of this patent is extended or adjusted under 35 U.S.C. 154(b) by 18 days.

(21) Appl. No.: 16/878,737

(22) Filed: May 20, 2020

(65) Prior Publication Data

US 2020/0289910 A1 Sep. 17, 2020

(51) Int. Cl.

| | |
|---|---|
| ***A63B 69/36*** | (2006.01) |
| ***A63B 71/06*** | (2006.01) |
| ***A63B 69/00*** | (2006.01) |

(52) U.S. Cl.

CPC ..... *A63B 71/0622* (2013.01); *A63B 69/002* (2013.01); *A63B 2071/0658* (2013.01); *A63B 2220/806* (2013.01); *A63B 2220/833* (2013.01); *A63B 2243/007* (2013.01)

(58) Field of Classification Search

CPC ..... A63B 71/0622; A63B 69/002; A63B 2220/833; A63B 2071/0658; A63B 2220/806; A63B 2243/007; A63B 2225/50; A63B 2024/0025; A63B 2024/0034; A63B 2024/0056; A63B 2220/13; A63B 2220/16; A63B 2210/50; A63B 2071/0602; A63B 2071/0694; A63B 71/023; A63B 2225/09

USPC ..... 473/218, 422, 417, 451, 452, 414, 440

See application file for complete search history.

(56) References Cited

U.S. PATENT DOCUMENTS

| | | | | | |
|---|---|---|---|---|---|
| 2,150,580 | A * | 3/1939 | Crowley | A63B 69/3623 | 473/273 |
| 2,457,351 | A * | 12/1948 | Crowley | A63B 69/3667 | 473/272 |
| 2,891,793 | A * | 6/1959 | Mudryjacka | A63C 19/06 | 473/414 |
| 3,515,385 | A * | 6/1970 | Gunderson | A63B 5/22 | 473/414 |
| 3,768,809 | A * | 10/1973 | Ciarfello | A63C 19/06 | 473/414 |
| 5,156,409 | A * | 10/1992 | Barnes | A63B 5/22 | 273/444 |
| 5,464,220 | A * | 11/1995 | Hansen | A63B 69/3667 | 473/218 |
| 5,755,641 | A * | 5/1998 | Pardella | A63B 9/00 | 482/23 |
| D446,276 | S * | 8/2001 | Bankhead | D21/791 | |
| 6,497,627 | B2 * | 12/2002 | Collins | A63B 69/3623 | 473/264 |
| 7,431,661 | B1 * | 10/2008 | Cailey | A63B 60/52 | 473/257 |

(Continued)

*Primary Examiner* — Nini F Legesse
(74) *Attorney, Agent, or Firm* — Stephen Bullock; Bullock Law

(57) ABSTRACT

Embodiments of the present invention are related to a football training tool with an angled head, a rectangular frustum body, a pair of upper lateral rails, a pair of bottom lateral rails and a bottom. The upper later rails, defined as arms, include foot angle guides. The football training tool may also include a top alignment notch on its head and a bottom alignment notch on its bottom.

19 Claims, 7 Drawing Sheets

(56) References Cited

U.S. PATENT DOCUMENTS

| | | | | |
|---|---|---|---|---|
| 8,021,242 | B1 * | 9/2011 | Tennison | A63B 69/3667 473/218 |
| 8,784,229 | B1 * | 7/2014 | McCullough | A63B 69/3667 473/257 |
| 8,834,287 | B1 * | 9/2014 | Reid | A63B 69/3667 473/266 |
| 9,550,104 | B2 * | 1/2017 | Taft | A63B 69/3667 |
| 2006/0226615 | A1 * | 10/2006 | Monaghan | A63H 33/006 280/47.3 |
| 2010/0298074 | A1 * | 11/2010 | Esposito | A63B 23/0464 473/438 |

* cited by examiner

FOOTBALL TRAINING TOOL

FIELD OF THE INVENTION

The present invention relates to systems and methods for training football players. More particularly, the present invention relates to a tool for training football long snappers.

BACKGROUND

Traditionally, football players training to become long snappers or improve their long snapping ability have had to rely on pure instruction. They have not been able to repetitively train with a demonstrative tool that outputs objective data in an easily usable and portable format.

There exists a need in the art for a training tool that is modular, portable, and easy to use that assists football players with positioning, motion, and muscle memory when training to long snap. Moreover, there exists a need in the art for a long snapping tool.

This background information is provided to reveal information believed by the applicant to be of possible relevance to the present invention. No admission is made as to prior art and nothing within the background should be construed as prior art against the present invention.

SUMMARY OF THE INVENTION

Embodiments of the present invention are related to a football training tool with an angled head, a rectangular frustum body, a pair of upper lateral rails, a pair of bottom lateral rails and a bottom. The upper later rails, defined as arms, may include foot angle guides. The football training tool may also include a top alignment notch on its angled head and a bottom alignment notch on its bottom.

In this embodiment, the foot angle guides may be slidable along the arms and may be attached to the arms via a sliding swivel assembly. The foot angle guides may also be rotatable via a swivel connector.

In this embodiment the football training tool may further include a pair of upper longitudinal rails with a slider and longitudinal distance marks on at least one upper longitudinal rail. The legs may be slidable along a lower longitudinal rail. The lower longitudinal rails may include longitudinal distance marks structured to measure positioning of the legs.

In some embodiments the top alignment notch and bottom alignment notch may be replaced with a top alignment camera and a bottom alignment camera respectively. In this embodiment, arm side cameras and leg side cameras may be located on the arms and legs proximate ends distal to the body. The arm side cameras and leg side cameras may be rotatable.

The football training tool may further include at least one of a V-brace, angled braces, T-braces, medial connectors, sliding connectors, and L-braces. The football training tool may be modular at each brace and connector. Furthermore, each brace and connector may create a modular section of the tool that is removably attached via at least one of friction fit, crimping, threading, spring ball and aperture, or a combination thereof.

Another embodiment of the football training tool may include an angled head, a rectangular frustum body, and a bottom. The body may include a pair of longitudinal sides and a pair of opposing upper lateral rails, defined as arms. The arms may extend from the pair of longitudinal sides. The body may also include a slidable and rotatable foot angle guide attached to each respective arm. The body may have a pair of opposing bottom lateral rails extending from the pair of longitudinal sides, defined as legs. The body may have a slider attached to at least one longitudinal side located between at least one arm and the angled head.

In this embodiment the legs may be slidable along the longitudinal sides. The angled head and the bottom each may include a respective alignment notch and the alignment notches may align linearly with each other. In some embodiments, the angled head, the arms, the legs, and the bottom each may include a camera. The camera on the angled head and camera on the bottom may be in alignment.

Another embodiment of the invention may be a football training tool including a top assembly with a V-Brace including a top alignment notch, a pair of top rails, and a pair of angled braces. It may have a body with a plurality of longitudinal rail pairs including a pair of upper longitudinal rails and a pair of lower longitudinal rails. The tool may also have a plurality of lateral rail pairs including a pair of upper lateral rails, defined as arms, with foot angle guides located on the arms. The tool may also have a pair of bottom lateral rails, defined as legs, a pair of medial connectors, a pair of T-Braces, and a pair of sliding connectors. The tool may have a bottom assembly including a bottom rail with a bottom alignment notch, a pair of L-Braces, and a slider.

In this embodiment, the pair of top rails may fittingly engage the V-Brace at a top rail first end to create a V-shaped top assembly. The pair of top rails may fittingly engage the pair of angled braces at the top rail second ends. The pair of upper longitudinal rails may fittingly engage the pair of angled braces at respective upper rail second ends to create an upper longitudinal section of the body. The pair of upper longitudinal rails may fittingly engage the pair of T-Braces at respective upper longitudinal rail second ends and respective T-Brace top connection points.

In this embodiment, the pair of arms may fittingly engage the T-Braces at lateral connection points. The pair of lower longitudinal rails and the upper longitudinal rails may be connected via medial connector. The pair of lower longitudinal rails may fittingly engage the bottom assembly at the L-Braces and the L-Braces may fittingly engage the bottom rail at opposing ends of the bottom rail. The lower longitudinal rails and at least one upper longitudinal rail may include longitudinal distance marks. Furthermore, the arms may include lateral distance marks.

The foot angle guides may be slidable along the arms and may be rotatable to splay away from the body. The legs may be slidable along the lower longitudinal rails and the slider may be slidable along at least one of the upper longitudinal rails. The top alignment notch and bottom alignment notch may be aligned with each other.

In this embodiment, the top assembly, arms, legs, and bottom assembly may each include a camera. The cameras on the angled head and bottom may be in alignment. Furthermore, the cameras on the arms and legs may be rotatable.

DETAILED DESCRIPTION OF THE INVENTION

The present invention will now be described in detail with reference to the accompanying drawings. The embodiment descriptions are illustrative and not intended to be limiting in any way. Other embodiments of the invention will readily suggest themselves to persons with ordinary skill in the art after having the benefit of this disclosure. Accordingly, the following embodiments are set forth without any loss of generality and without imposing limitation upon the claimed invention.

Directional terms such as "top" "bottom" "right" "left" and other like terms are used for the convenience of the reader in reference to the drawings. Additionally, the description may contain terminology to convey position, orientation, and direction without departing from the principles of the present invention. Such positional language should be taken in context of the represented drawings.

Quantitative terms such as "generally" "substantially" "mostly" and other like terms are used to mean that the referred object, characteristic, or quality constitutes a majority of the referenced subject. Likewise, use of the terms such as first and second do not necessarily designate a limitation of quantity. Such terms may be used as a method of describing the presence of at least one of the referenced elements or may provide a means of differentiating orientation. The meaning of any term within this description is dependent upon the context within which it is used, and the meaning may be expressly modified.

Figure 1:
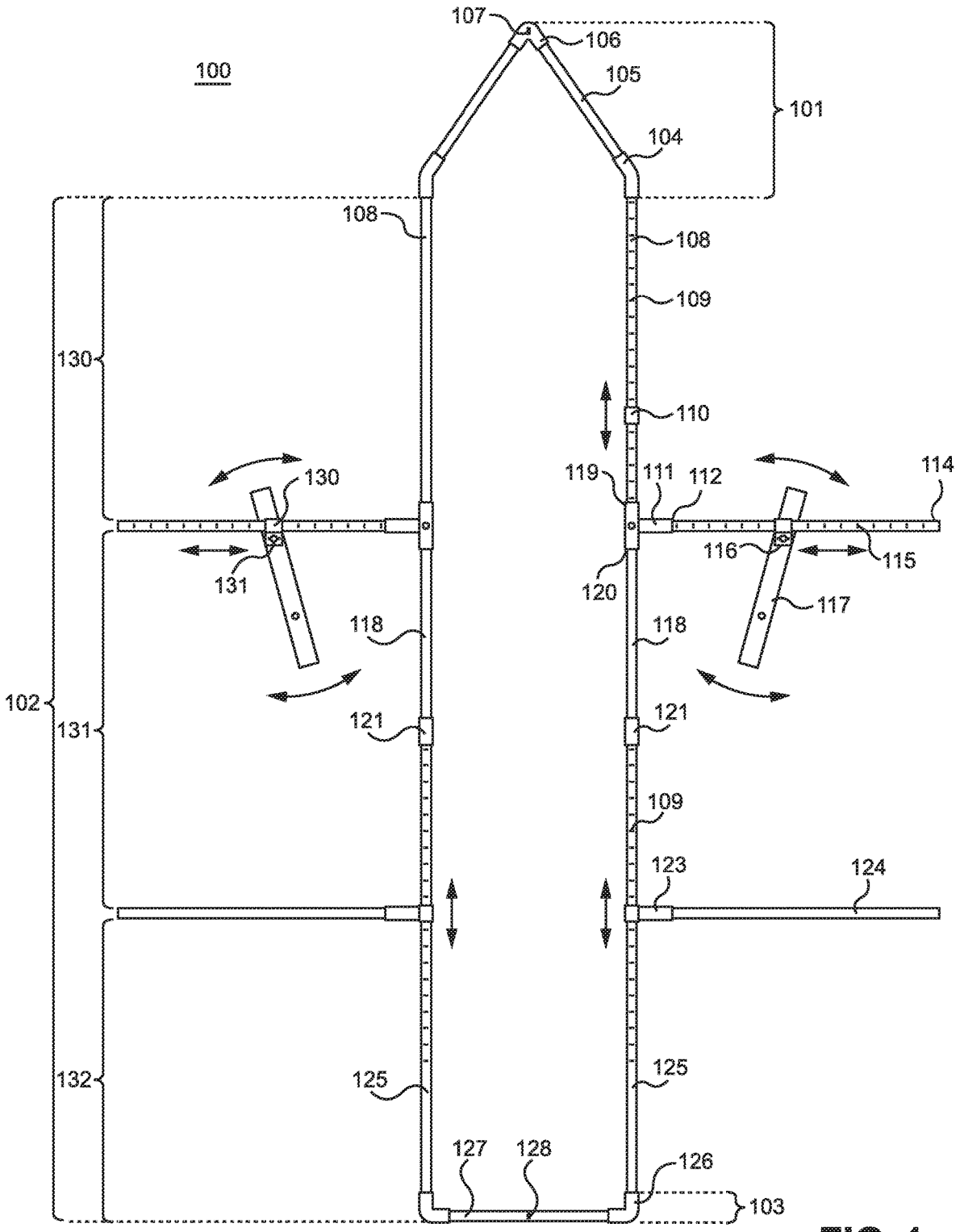
FIG. 1 is a top planar view of a football training tool.

Referring now to FIG. 1, a football training tool 100, hereinafter referred to as the tool 100, will be described. The tool 100 may include a top assembly 101, a body 102, and a bottom assembly 103. The body 102 may be between the top assembly 101 and bottom assembly 102 so that one end of the top assembly 101 may connect to one end of the body 102. Furthermore, an opposing end of the body 102 may connect to the bottom assembly 103.

The top assembly 101 may include a pair of angled braces 104 fittingly and removably engaged with a pair of top rails 105. The angled braces 104 may be hollow elbows with a vertical portion terminated by an angled portion. One end of the angled braces 104 may include openings to receive upper ends of the body 102. Other ends of the angled braces 104 may include openings to receive the top rails 105 therein.

The top rails 105 may fittingly and removably engage with a v-brace 106 via openings in the v-brace 106 structured to receive the top rails 105 therein. The v-brace 106 may be angled so that the top assembly 101 resembles two thirds of a triangle with a missing base when the top rails 105 are connected to the v-brace 106. Therefore, the top assembly may be considered an angled head of the tool 100.

The v-brace may also include a top alignment notch 107 located at a medial point on its outward facing surface. In some embodiments, the top alignment notch 107 may be located at a point where the v-brace 106 can be bifurcated into two symmetric halves.

The top end of the body 102 may connect to a lower end of the top assembly 101. Furthermore, the body 102 itself may be divided into a body top section 130, a body medial section 131, and a body lower section 132. The body 102 may resemble a rectangular frustum with a pair of longitudinal sides, a squared off bottom 103, but not a squared off top.

The body top section 130 may include a pair of upper longitudinal rails 108. The upper longitudinal rails 108 may be defined as distance rails 108. The distance rails 108 may connect to the angled braces 104 at one end and the top connection points 119 of the t-braces at 111 opposing ends. The distance rails 108 may engage openings within the angled braces 104 and the t-braces 111 by fitting therein.

The upper right longitudinal rail 108 or in some cases upper left longitudinal rail 108 may include longitudinal distance marks 109 and a slider 110. The longitudinal distance marks 109 may be markings or notches on the outward facing surface of the upper longitudinal rail 108 at regular intervals. By way of non-limiting example, the longitudinal distance marks 109 may be at one-inch intervals to indicate a distance of one inch between marks. The longitudinal distance marks 109 on the upper longitudinal rail 108 may assist with determining a measurable distance along the rail for slider 110 positioning.

The slider 110 may be a hollow cylinder with open ends that slidably engages the outer surface of the upper longitudinal rail 108. By moving longitudinally along the upper longitudinal rail 108, the slider 110 may be placed at a desired location thereon with the longitudinal distance marks 109 used as guiding distances.

The body 102 may also include a body medial section 131 located between a pair of upper lateral rails 114, defined as arms 114 and a pair of bottom lateral rails 124, defined as legs 124. T-braces 111 may connect the arms 114 to the body 102. The distance rails 108 may connect at one end to the t-braces 111 at top connection points 119. The arms 114 may connect to the t-braces 111 at lateral connection points 112.

A pair of medial rails 118 may connect to the bottoms of the t-braces 111 at bottom connection points 120. The medial rails 118 may extend from the bottom connection points 120 to upper openings of a pair of medial connectors 121. A pair of lower longitudinal rails 125 may extend from lower openings of the medial connectors 121 down to a pair of L-braces 126.

The L-braces 126 may be a pair of elbow joints that connect to the lower longitudinal rails 125 at one opening and a bottom rail 127 at an opening perpendicular thereto. The bottom rail 127 may include a bottom alignment notch 128 located at a medial point on its outward facing surface. In some embodiments, the bottom alignment notch 128 may be located at a point where the bottom rail 127 can be bifurcated into two symmetric halves. The bottom assembly may include the L-braces 126 and the bottom rail 127 with the bottom alignment notch 128 thereon. The bottom alignment notch 128 and the top alignment notch 107 may be in alignment with each other.

The arms 114 may extend perpendicularly from the body 102 at lateral connection points 112. Connected to each arm 112 may be a foot angle guide 117 attached to its respective arm 114 by a sliding swivel assembly 116. The sliding swivel assembly 116 may include an attachment brace 130, a swivel connector 131 and nut (not shown). The attachment brace 130 may be a flattened ring with holes at its ends structured to wrap around its respective arm 114 and connect to the foot angle guide 117 via swivel connector 131. The swivel connector 131 may be structured to fit through the holes of the attachment brace 130 which may be wrapped around the arm 114 so that the attachment brace's 130 flattened ends are together and its holes aligned.

The swivel connector 131, which in some embodiments may resemble a bolt, may fit through the holes of the attachment brace 130 and fit through a hole on the foot angle guide 117. The swivel connector 131 may be tightened via nut at the opposing side of the foot angle guide 117 so that the sliding swivel assembly 116 may slidably connect the foot angle guide 117 to the arm 114.

When connected, the foot angle guides 117 may slide along the arms from left to right when viewing the tool 100 from overhead. Furthermore, the foot angle guide 117 may use the swivel connector 131 as an axis to rotate the foot angle guide 117 thereon. Therefore, the foot angle guides 117 may be splayed at a desired angle with respect to the body 102. Likewise, the foot angle guides may be slidably distanced from the body 102 at a desired measurement along the arms 114 via the sliding swivel assembly 116.

Lateral distance marks 115 located on the outer surfaces of the arms 114 may assist a user with measuring the desired distance of the foot angle guides 114 from the body 102. In some embodiments, the lateral distance marks 115 may be spaced at one (1) inch. In other embodiments, the lateral distance marks 115 may be spaced at shorter or longer distances.

The legs 124 may be slidably attached to the body 102 via sliding connectors 123 at perpendicular or near perpendicular angles. The sliding connectors 123 may include tunneled portions structured to receive the lower longitudinal rail 125 therethrough. This portion of the sliding connector 123 may allow for the sliding connectors 123, and therefore the legs 124, to slide longitudinally along the body 102 between the medial connector 121 and the L-braces 126 on the lower longitudinal rails 125.

The tool 100 may be modularized at its connection points. By way of non-limiting example, these connection points may include the V-brace 106, the angled braces 104, the T-braces 111, the medial connectors 121, the sliding connectors 123, and the L-braces 126. By way of non-limiting example, each modular section of the tool 100 may be removably attached via friction fit, crimping, threading, spring ball and aperture, or a combination thereof.

The tool 100 itself may be made of any strong and durable material. By way of non-limiting example, the tool 100 may be made of metal or alloy such as aluminum or steel, plastic such as polycarbonate, glass, wood, rubber, and the like. Furthermore, the tool 100 may be made of a combination of these materials. For example, the body 102 and legs 124 may be made of plastic, but the connection points may be made of metal or vice versa.

Figure 2:
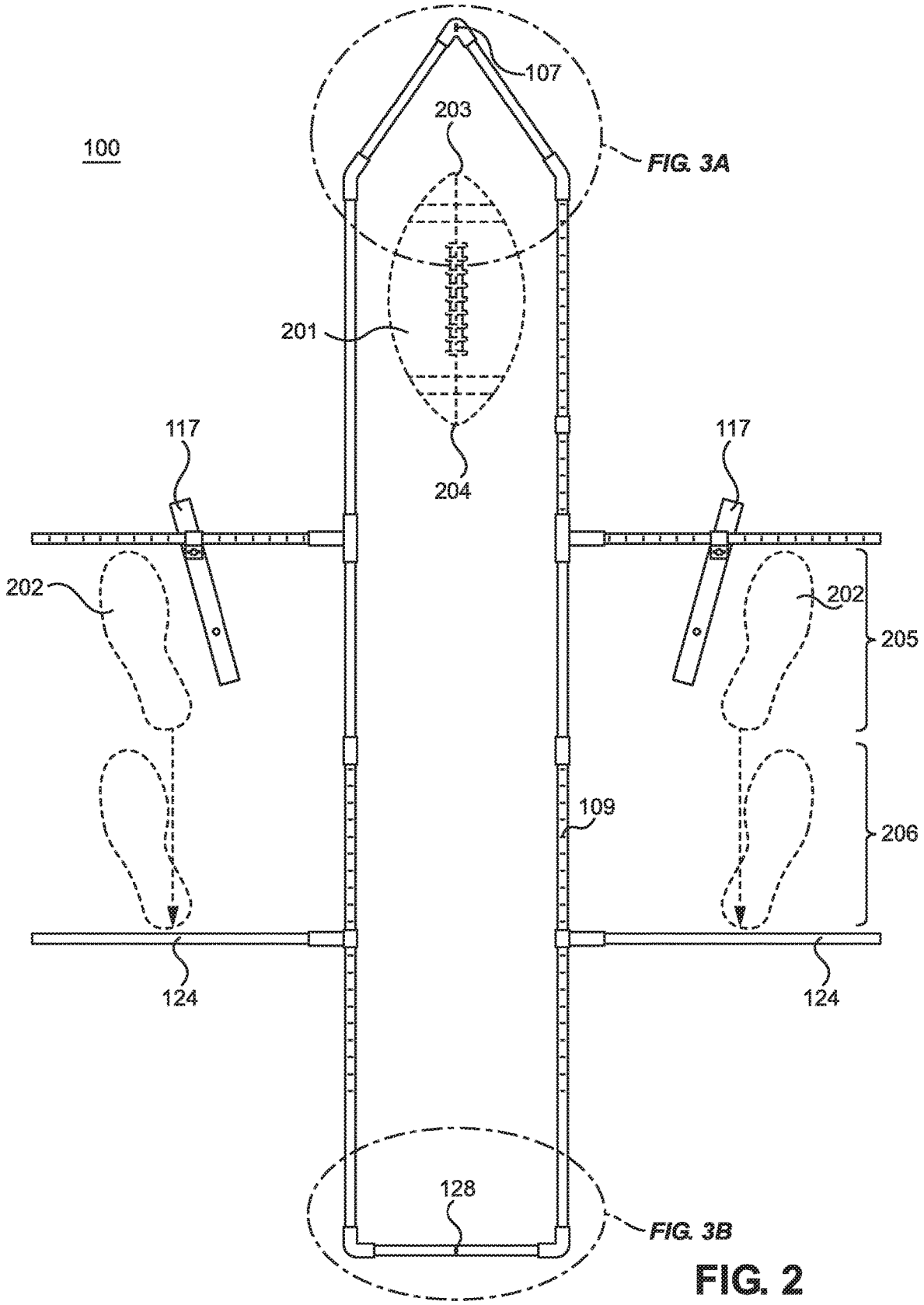
FIG. 2 is a top planar view of the football training tool illustrated in FIG. 1 with demonstrated ball and foot placement.

FIG. 2 illustrates placement of a football 201 and a user's foot 202 when utilizing the tool 100. The football 201 may be placed within the upper body 102 of the tool 100 so that the top point 203 of the football 201 aligns with the top alignment notch 107. Likewise, the football 201 may be positioned so that the bottom point 204 of the football 201 aligns with the bottom alignment notch 128.

The foot angle guides 117 may be angled to suit the user's preference so that each foot 202 is splayed optimally. Once the football is snapped, a user's feet 202 located at the first position 205 may jump backwards, with respect to the user, and land at a second position 206. The legs 124 of the tool 100 may be slidably positioned to meet the heels of the user's feet 202 once the user has reached the second position 206. Each time a user snaps the football 201, the legs 124 of the tool 100 may be positioned according to the second position 206 landing, and the measured distance may be realized and recorded using the longitudinal distance marks 109. Repeating this process may assist the user with finding their optimal foot angle and second position 206.

Figure 3A:
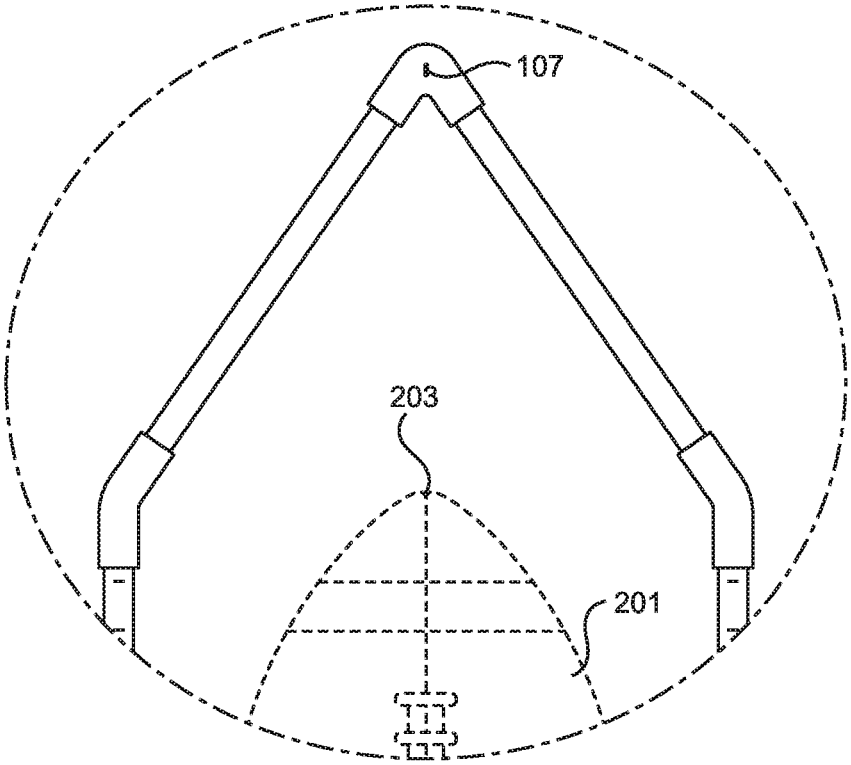
FIG. 3A is an enlarged view of a football training tool top assembly.
Figure 3B:
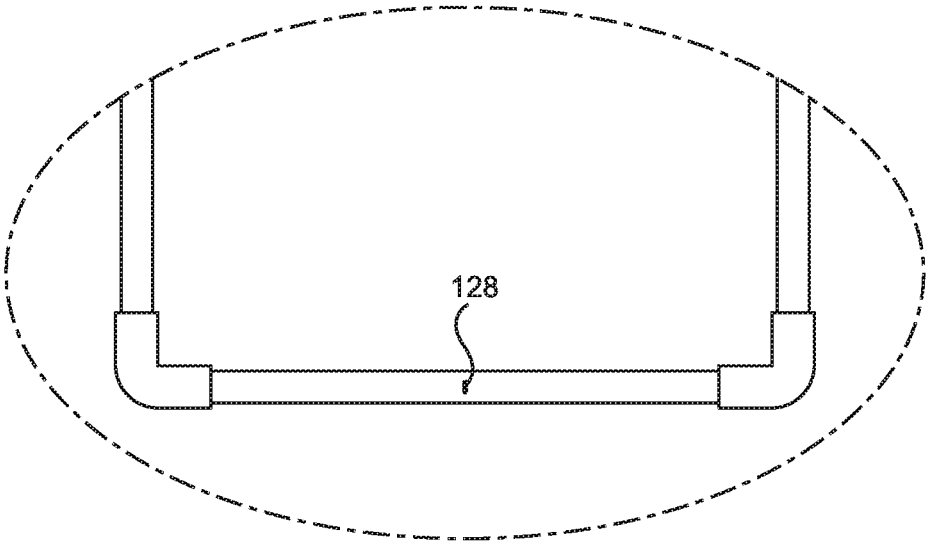
FIG. 3B is an enlarged view of a football training tool bottom assembly.

FIGS. 3A and 3B emphasize the importance of the top alignment notch 107 and the bottom alignment, notch 128. Each notch allows a user to align the football 201 at the starting position. Furthermore, as will be described hereinafter, each notch may assist the user with snapping the football 201 in a straight line along the longitudinal length of the tool 100 as aligned by the top and bottom alignment notches 107, 128.

Figure 4A:
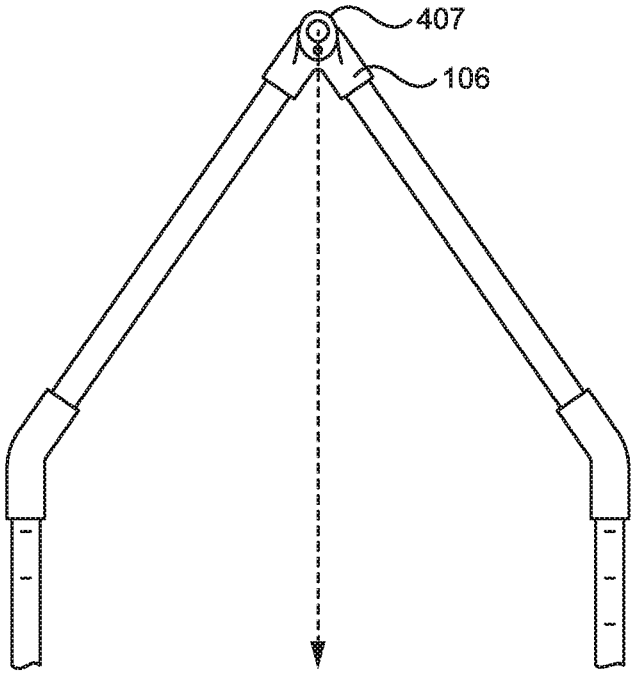
FIG. 4A is a segmented view of another embodiment of a football training tool top assembly.

FIGS. 4A and 48 illustrate that in another embodiment the top and bottom alignment notches 107, 128 may be replaced with cameras. In this embodiment, the top alignment notch 107 may be replaced with a top alignment camera 407. The top alignment camera 407 may extend distally from an outward surface of the V-brace 106 so that it may be positioned to record the top point 203 of the football 201 when in its initial position. Furthermore, the positioning of the top alignment camera 407 on the V-brace 106 may allow for recording the flight of the football 201 when snapped and the motion of the user during the snap from a top to bottom perspective with respect to the tool 100.

Likewise, in this embodiment, the bottom alignment notch 128 may be replaced with a bottom alignment camera 428. The bottom alignment camera 428 may extend distally from an outward surface of the bottom rail 127 so that it may be positioned to record the bottom point 204 of the football 201 when in its initial position. Furthermore, the positioning of the bottom alignment camera 428 on the bottom rail 127 may allow for recording the flight of the football 201 when snapped. It may also allow for recording, the motion of the user during the snap from a bottom to top perspective with respect to the tool 100.

Figure 4B:
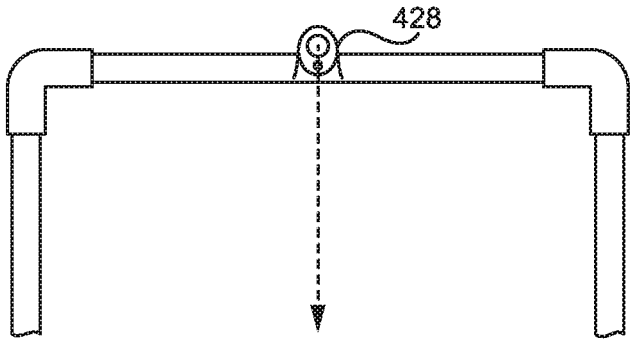
FIG. 4B is a segmented view of another embodiment of a football training tool bottom assembly.

In both FIG. 4A and FIG. 4B, the cameras themselves may act as alignment markers for the user to use when aligning and snapping the football. In some embodiments, top portions of the cameras may be conspicuously colored or shaped so as to direct a user's attention to their alignment. In other embodiments, cameras may fit overtop of the top alignment notch 107 and the bottom alignment notch 128 instead of replacing them.

Figure 4C:
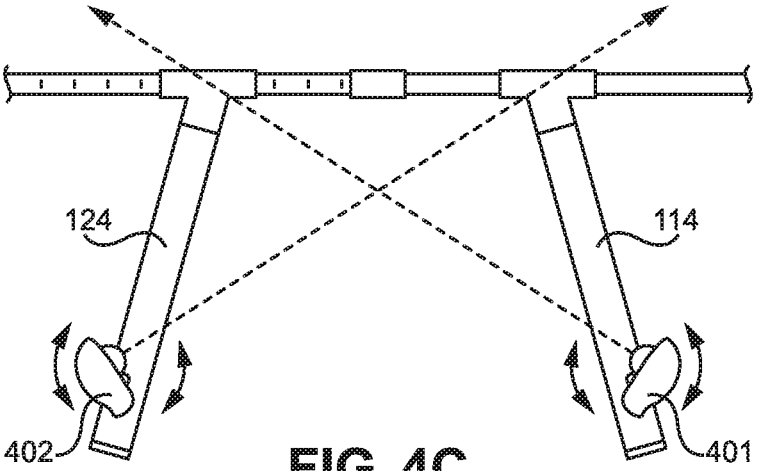
FIG. 4C is a perspective partial side view of another embodiment of a football training tool body.

FIG. 4C illustrates that arm side cameras 401 and leg side cameras 402 may be located proximate ends of the arms 114 and legs 124 of the tool 100. These cameras may extend distally from an outward surface of the arms 114 and legs 124 of the tool 100 so that they may record both side views of the user and the football 201 from initial positioning through the end of the snap. Both the arm side cameras 401 and leg side cameras 402 may be on a swivel so that they may rotate from side to side. This may allow for the cameras to capture optimal angles along the longitudinal length of the tool 100. Furthermore, all cameras including the top alignment camera 407, the bottom alignment camera 428, the arm side cameras 401, and leg side cameras 402 may be structured to angle up and down with respect to the ground so as to further capture optimal angles of a user when using the tool 100. All cameras may be equipped with shortrange communication so as to transmit the images to a smart device or recording system. In some embodiments, short range communication may be through Wi-Fi and in other embodiments the shortrange communication may be through electrical wiring.

Figure 5:
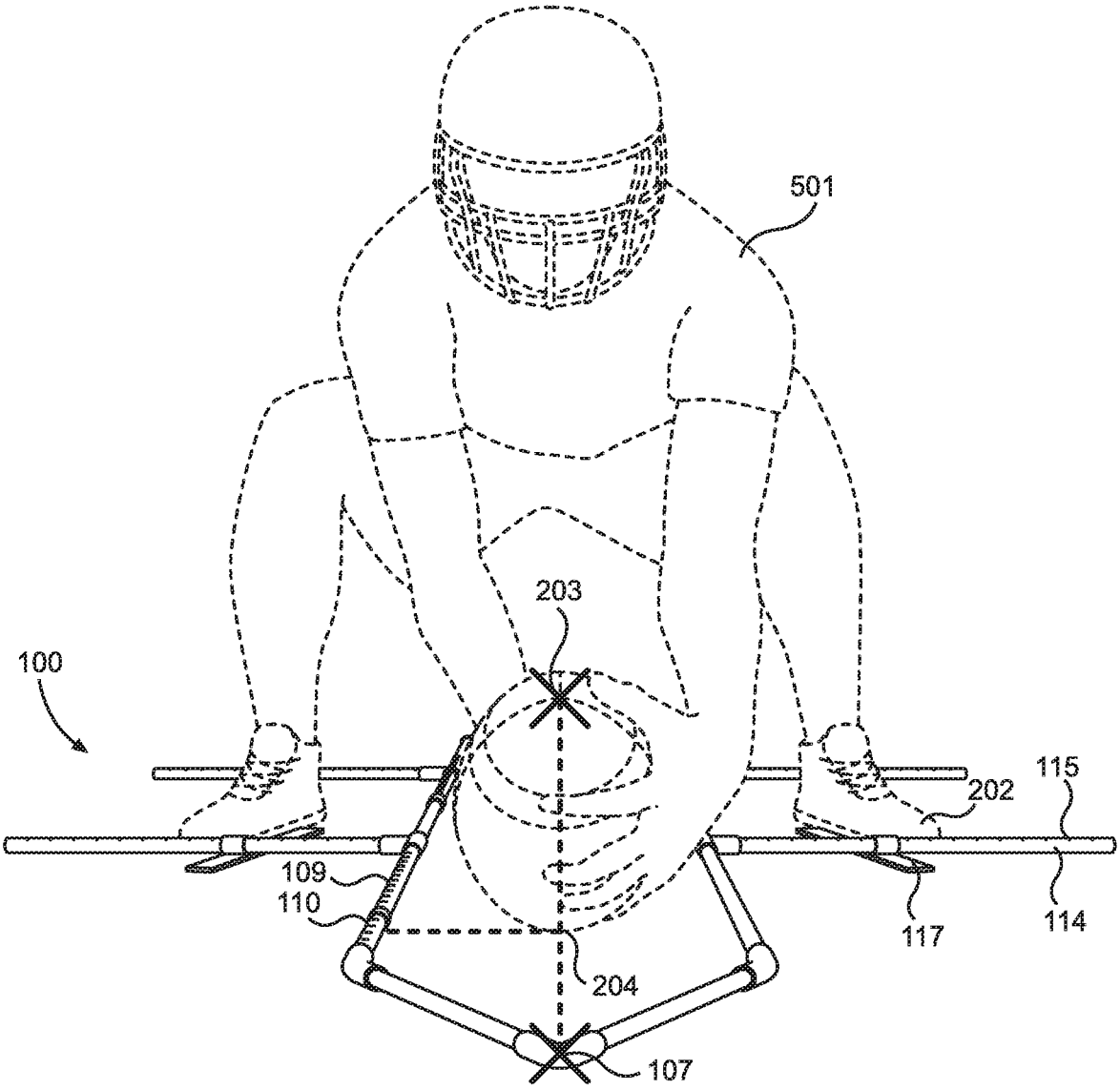
FIG. 5 is a perspective front view of the football training tool as used by a player in an initial position.
Figure 6:
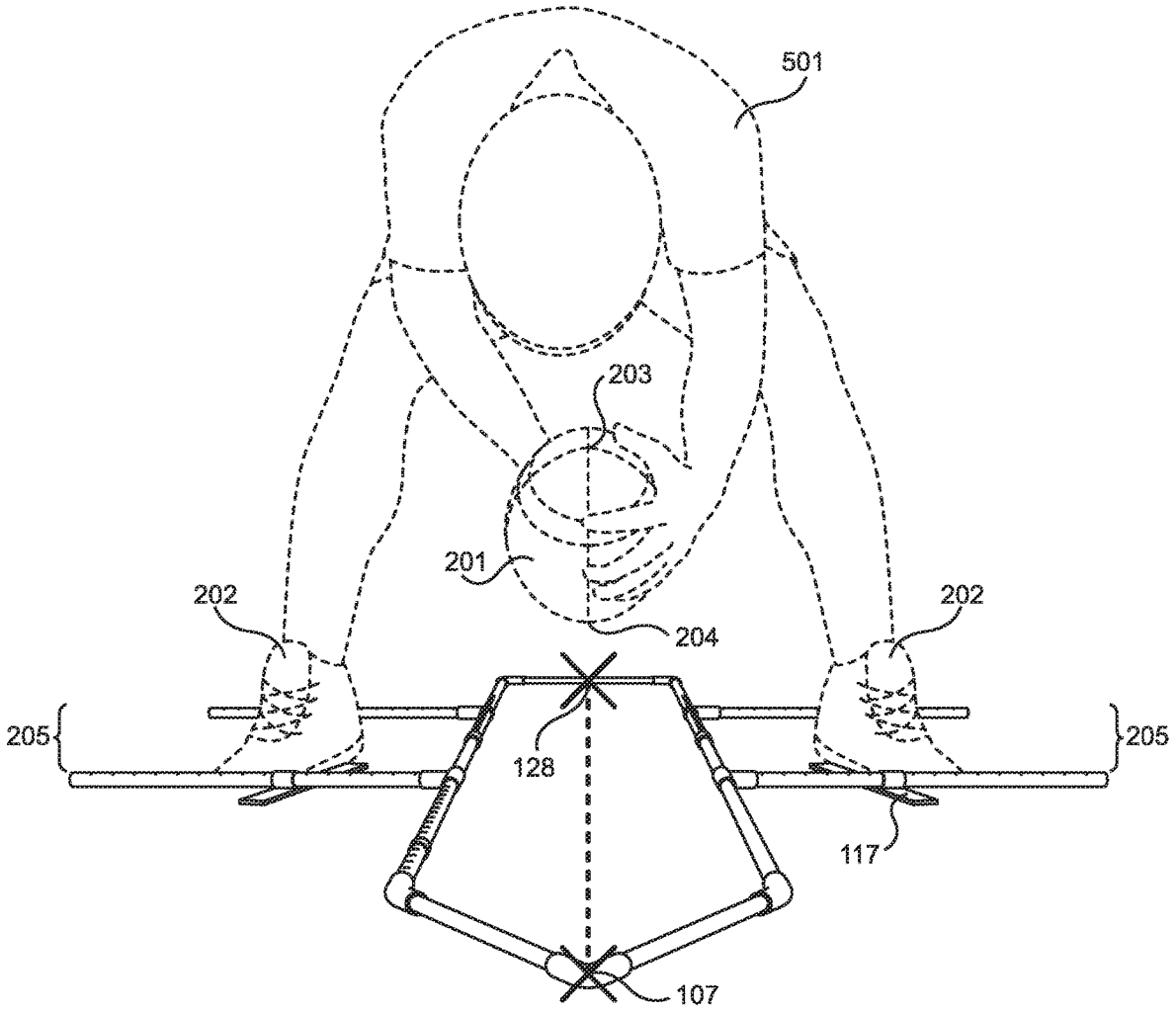
FIG. 6 is a perspective front view of the football training tool as used by a player in a mid-snap position.
Figure 7:
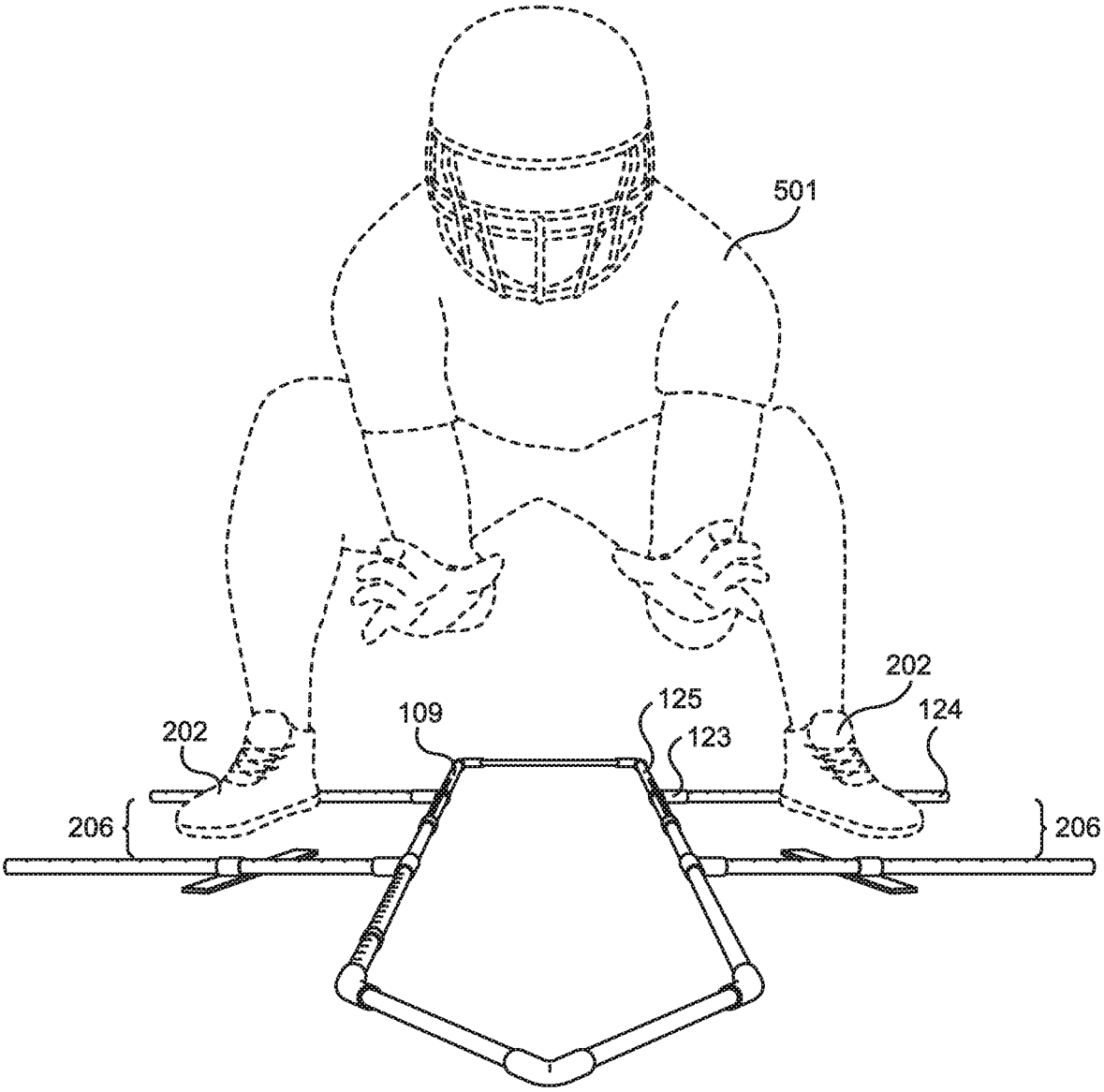
FIG. 7 is a perspective front view of the football training tool as used by a player in a finishing position.

FIGS. 5 through 7 illustrate a user 501 utilizing the tool 100 in a long snapping practice scenario. FIG. 5 illustrates the user 501 in a starting position with their feet 202 in the first position 205. The foot angle guides 117 are positioned to guide the user 501 with how their feet 202 should be splayed. The foot angle guides 117 are also distanced away from the body 102 of the tool 100 along the arms 114 utilizing the lateral distance marks 115 and sliding swivel assembly 116 to guide the user 501 with how far apart the user's 501 feet 202 should be distanced.

The slider 110 has been positioned with the longitudinal distance marks 109 as guidance for where to position the bottom point 204 of the football 201 along the body 102 of the tool 100. The top point 203 of the football 201 is aligned with the top alignment notch 107 and the bottom point 204 of the football 201 is aligned with the slider 110. The user 501 is now ready to begin snapping the football 201.

FIG. 6 illustrates a user 501 mid-snap. The user 501 is utilizing the top alignment notch 107 in conjunction with the bottom alignment notch 128 to ensure the football 201 is being snapped straight. As shown, the top point 203 of the football 201 is still aligned with the top alignment notch 107 and the bottom point 204 of the football 201 is still aligned with the bottom alignment notch 128. Therefore, the motion and positioning of the user 501 is all in alignment with the longitudinal center of the tool 100. The feet 202 of the user 501 are still in the first position 205. Furthermore, the feet 202 are splayed and distanced according to the foot angle guides 117.

FIG. 7 illustrates a user's positioning after releasing the football 201 from the snap. The user's 501 feet 202 have jumped back to the second position 206 but are still splayed at the same angle as in the first position 205. The legs 124 of the tool 100 have been moved via the sliding connector along the lower longitudinal rail 125 to meet the heels of the user 501 in the second position 206. The longitudinal distance marks 109 are able to be used to document the optimal positioning of the user's 501 feet 202 after a well aligned and straight snap.

That which is claimed is:

1. A football training tool comprising
an angled head with top alignment notch;
a rectangular frustum body;
a pair of upper lateral rails, defined as arms, comprising foot angle guides;
a pair of bottom lateral rails, defined as legs; and
a bottom rail with a bottom alignment notch;
wherein the football training tool includes at least one of a V-brace, angled braces, T-braces, medial connectors, sliding connectors, and L-braces.

2. The football training tool of claim 1 wherein the foot angle guides are slidable along the arms.

3. The football training tool of claim 1 wherein the foot angle guides are attached to the arms via a sliding swivel assembly and rotatable via a swivel connector.

4. The football training tool of claim 1 further comprising a pair of upper longitudinal rails with a slider and longitudinal distance marks on at least one upper longitudinal rail.

5. The football training tool of claim 1 wherein the legs are slidable along a lower longitudinal rail.

6. The football training tool of claim 5 further comprising lower longitudinal rails with longitudinal distance marks configured to measure positioning of the legs.

7. The football training tool of claim 1 wherein the top alignment notch and bottom alignment notch are replaced with a top alignment camera and a bottom alignment camera respectively.

8. The football training tool of claim 1 wherein arm side cameras and leg side cameras are located on the arms and legs proximate ends distal to the body.

9. The football training tool of claim 8 wherein the arm side cameras and leg side cameras are rotatable.

10. The football training tool of claim 1 wherein the football training tool is modular at each brace and connector; and wherein each brace and connector creates a modular section of the tool that is removably attached via friction fit, crimping, threading, spring ball and aperture, or a combination thereof.

11. A football training tool comprising:
an angled head;
a rectangular frustum body comprising
a pair of longitudinal sides,
a pair of opposing upper lateral rails, defined as arms, extending from the pair of longitudinal sides,
a slidable and rotatable foot angle guide attached to each respective arm,
a pair of opposing bottom lateral rails extending from the pair of longitudinal sides, defined as legs, and
a slider attached to at least one longitudinal side located between at least one arm and the angled head, and
a bottom rail;
wherein the foot angle guides are attached to the arms via a sliding swivel assembly and rotatable via a swivel connector.

12. The football training tool of claim 11 wherein the legs are slidable along the longitudinal sides.

13. The football training tool of claim 11 wherein the angled head and the bottom rail each include a respective alignment notch.

14. The football training tool of claim 13 wherein the alignment notches align linearly with each other.

15. The football training tool of claim 11 wherein the angled head, arms, legs, and bottom rail each comprise a camera.

16. The football training tool of claim 15 wherein the camera on the angled head and camera on the bottom rail are in alignment.

17. A football training tool comprising:
an angled head comprising
a V-Brace with a top alignment notch,
a pair of top rails, and
a pair of angled braces;
a body comprising
a plurality of longitudinal rail pairs comprising
a pair of upper longitudinal rails, and
a pair of lower longitudinal rails;
a plurality of lateral rail pairs comprising
a pair of upper lateral rails, defined as arms, comprising foot angle guides, and
a pair of bottom lateral rails, defined as legs;
a pair of medial connectors;
a pair of T-Braces; and
a pair of sliding connectors;
a bottom assembly comprising
a bottom rail with a bottom alignment notch, and
a pair of L-Braces; and
a slider;
wherein the foot angle guides are attached to the arms via a sliding swivel assembly and rotatable via a swivel connector;
wherein the pair of top rails fittingly engage the V-Brace at a top rail first end to create a V-shaped angled head;

wherein the pair of top rails fittingly engage the pair of angled braces at the top rail second ends;

wherein the pair of upper longitudinal rails fittingly engage the pair of angled braces at respective upper rail second ends to create an upper longitudinal section of the body;

wherein the pair of upper longitudinal rails fittingly engage the pair of T-Braces at respective upper longitudinal rail second ends and respective T-Brace top connection points;

wherein the pair of arms fittingly engage the T-Braces at lateral connection points;

wherein the pair of lower longitudinal rails and the upper longitudinal rails are connected via medial connector;

wherein the pair of lower longitudinal rails fittingly engage the bottom assembly at the L-Braces;

wherein the L-Braces fittingly engage the bottom rail at opposing ends of the bottom rail;

wherein the lower longitudinal rails and at least one upper longitudinal rail comprise longitudinal distance marks;

wherein the arms comprise lateral distance marks;

wherein the foot angle guides are slidable along the arms;

wherein the foot angle guides are rotatable to splay away from the body;

wherein the legs are slidable along the lower longitudinal rails;

wherein the slider is slidable along at least one of the upper longitudinal rails;

wherein the top alignment notch and bottom alignment notch are aligned with each other.

18. The football training tool of claim 17 wherein the angled head, arms, legs, and bottom assembly each comprise a camera.

19. The football training tool of claim 18 wherein the cameras on the angled head and bottom assembly are in alignment; and wherein the cameras on the arms and legs are rotatable.

* * * * *